US011103117B2

(12) United States Patent
Gorrell et al.

(10) Patent No.: US 11,103,117 B2
(45) Date of Patent: Aug. 31, 2021

(54) CLEANING ARTICLES INCLUDING SCOURING BODIES THAT FORM PRINTED INSTRUCTIONS

(71) Applicant: 3M INNOVATIVE PROPERTIES COMPANY, St. Paul, MN (US)

(72) Inventors: Matthew W. Gorrell, South Saint Paul, MN (US); David C. Raithel, Hudson, WI (US); Lauren K. Carlson, Saint Paul, MN (US); James P. Gardner, Jr., Stillwater, MN (US)

(73) Assignee: 3M INNOVATIVE PROPERTIES COMPANY, St. Paul, MN (US)

( * ) Notice: Subject to any disclaimer, the term of this patent is extended or adjusted under 35 U.S.C. 154(b) by 31 days.

(21) Appl. No.: 16/097,430

(22) PCT Filed: Apr. 24, 2017

(86) PCT No.: PCT/IB2017/052347

§ 371 (c)(1),
(2) Date: Oct. 29, 2018

(87) PCT Pub. No.: WO2017/187320

PCT Pub. Date: Nov. 2, 2017

(65) Prior Publication Data

US 2019/0133403 A1 May 9, 2019

Related U.S. Application Data

(60) Provisional application No. 62/329,716, filed on Apr. 29, 2016.

(51) Int. Cl.
*A47L 13/16* (2006.01)
*G09F 3/00* (2006.01)

(52) U.S. Cl.
CPC ..... *A47L 13/16* (2013.01); *G09F 3/00* (2013.01)

(58) Field of Classification Search
CPC ..... A47L 13/16; G09F 3/00
See application file for complete search history.

(56) References Cited

U.S. PATENT DOCUMENTS 4,142,334 A 3/1979 Kirsch
4,911,734 A 3/1990 Short
(Continued)

FOREIGN PATENT DOCUMENTS

JP 2004261261 9/2004
JP 2004261261 A * 9/2004
(Continued)

OTHER PUBLICATIONS

JP-2004261261-A—English Machine Translation (Year: 2004).*
International Search Report for PCT International Application No. PCT/IB2017/052347, dated Sep. 22, 2017, 7 pages.

*Primary Examiner* — Marc Carlson
(74) *Attorney, Agent, or Firm* — Vincent Pham

(57) ABSTRACT

In one example, a scouring article comprises: a backing layer having opposed first and second major surfaces; and a visually discernable functional material provided on at least one of the first and second major surfaces; wherein the functional material comprises a resin, and further wherein the functional material is configured to communicate information to a user of the scouring article regarding an intended end-use application of the scouring article. In another example, an abrasive article comprises: a pad having a scrubbing surface; and a plurality of shaped abrasive structures disposed on the scrubbing surface; wherein the plu-
(Continued)

rality of shaped abrasive structures are arranged to provide an indication regarding a characteristic of the abrasive structures.

19 Claims, 8 Drawing Sheets

(56) References Cited

U.S. PATENT DOCUMENTS

| | | | | |
|---|---|---|---|---|
| 5,227,229 | A | 7/1993 | McMahan McCoy | |
| 6,226,961 | B1 * | 5/2001 | Gordon | G09F 3/00 15/244.4 |
| 6,264,533 | B1 | 7/2001 | Kummeth | |
| 6,312,484 | B1 | 11/2001 | Chou | |
| 6,599,177 | B2 | 7/2003 | Nevoret | |
| 7,108,596 | B2 | 9/2006 | Nevoret | |
| 7,393,371 | B2 | 7/2008 | O'Gary | |
| 8,077,555 | B1 * | 12/2011 | Lovato | A47L 13/16 15/244.4 |
| 8,162,153 | B2 | 4/2012 | Fox | |
| 8,343,882 | B2 | 1/2013 | Johnson | |
| 2003/0121117 | A1 * | 7/2003 | Isenberg | A47L 13/16 15/209.1 |
| 2003/0124935 | A1 | 7/2003 | Smith | |
| 2003/0124953 | A1 | 7/2003 | Hornsby | |
| 2004/0093679 | A1 * | 5/2004 | Kukoff | A47L 13/16 15/118 |
| 2005/0125926 | A1 | 6/2005 | Rekum | |
| 2006/0003912 | A1 * | 1/2006 | Lindsay | A47L 13/16 510/267 |
| 2006/0086017 | A1 * | 4/2006 | Gordon | G09F 3/00 40/299.01 |
| 2006/0185112 | A1 | 8/2006 | Brookes-Weiss | |
| 2007/0271719 | A1 | 11/2007 | Schindler | |
| 2007/0298697 | A1 | 12/2007 | Charmoille | |
| 2011/0021114 | A1 * | 1/2011 | McArdle | B24B 37/245 451/8 |
| 2012/0064324 | A1 | 3/2012 | Arellano | |
| 2013/0337714 | A1 | 12/2013 | Shah | |

FOREIGN PATENT DOCUMENTS

| | | |
|---|---|---|
| WO | WO 2007-100497 | 9/2007 |
| WO | WO 2015-123635 | 8/2015 |

* cited by examiner

CLEANING ARTICLES INCLUDING SCOURING BODIES THAT FORM PRINTED INSTRUCTIONS

CROSS REFERENCE TO RELATED APPLICATIONS

This application is a national stage filing under 35 U.S.C. 371 of PCT/IB2017/052347, filed Apr. 24, 2017, which claims the benefit of Provisional Application No. 62/329,716, filed Apr. 29, 2016, the disclosure of which is incorporated by reference in their entirety herein.

TECHNICAL FIELD

This document pertains generally, but not by way of limitation, to nonwoven articles for cleaning various surfaces, such as food-contacting surfaces and the like. More specifically, but not by way of limitation, this document relates to systems and methods for including printed instructions on various cleaning articles.

BACKGROUND

In the cleaning industry, one type of cleaning article is often used for one type of cleaning activity, while a second cleaning article may be used for a different cleaning activity. Often, both cleaning articles are located in the same work area and can erroneously be used on the wrong surface. Additionally, it is common in the cleaning industry for employees to speak one or more languages and often workers may not be proficient in the local language or able to communicate easily with their co-workers, particularly instructions about how to use cleaning articles or perform various cleaning activities.

U.S. Pat. No. 4,142,334 to Kirsch et al., U.S. Pat. No. 7,108,596 to Nevoret et al., U.S. Pat. No. 8,343,882 to Johnson et al., U.S. Pub. No. 2003/0124935 to Smith et al. and US Pub. No. 2007/0271719 to Schindler et al. disclose various cleaning articles.

OVERVIEW

The present inventors have recognized, among other things, problems associated with confusion over improper use of cleaning articles can lead to damaged surfaces, improperly cleaned surfaces, cross-contamination of work areas and re-work. Furthermore, the present inventors have recognized that condition or effectiveness of a cleaning article cannot always be readily deduced from its appearance, which can lead to improperly cleaned surfaces or increased cleaning times.

The inventors have developed a cleaning article that can include printed instructions for the cleaning article that are fabricated from the abrasive cleaning material. The printed instructions can indicate the intended surface to be cleaned and/or the type of scouring surface on the cleaning article, and can indicate the instructions in one or more languages. Furthermore, the abrasive cleaning material can be designed to break away from a backing material at a time when the cleaning article becomes ineffective and should be replaced. For example, a user can know that the cleaning article needs to be replaced when the printed instructions have disappeared or partially disappeared.

In one embodiment, a scouring article comprises: a backing layer having opposed first and second major surfaces; and a visually discernable functional material provided on at least one of the first and second major surfaces; wherein the functional material comprises a resin, and further wherein the functional material is configured to communicate information to a user of the scouring article regarding an intended end-use application of the scouring article.

In another embodiment, an abrasive article comprises: a pad having a scrubbing surface; and a plurality of shaped abrasive structures disposed on the scrubbing surface; wherein the plurality of shaped abrasive structures are arranged to provide an indication regarding a characteristic of the abrasive structures.

This overview is intended to provide an overview of subject matter of the present patent application. It is not intended to provide an exclusive or exhaustive explanation of the invention. The detailed description is included to provide further information about the present patent application.

Figure 1:
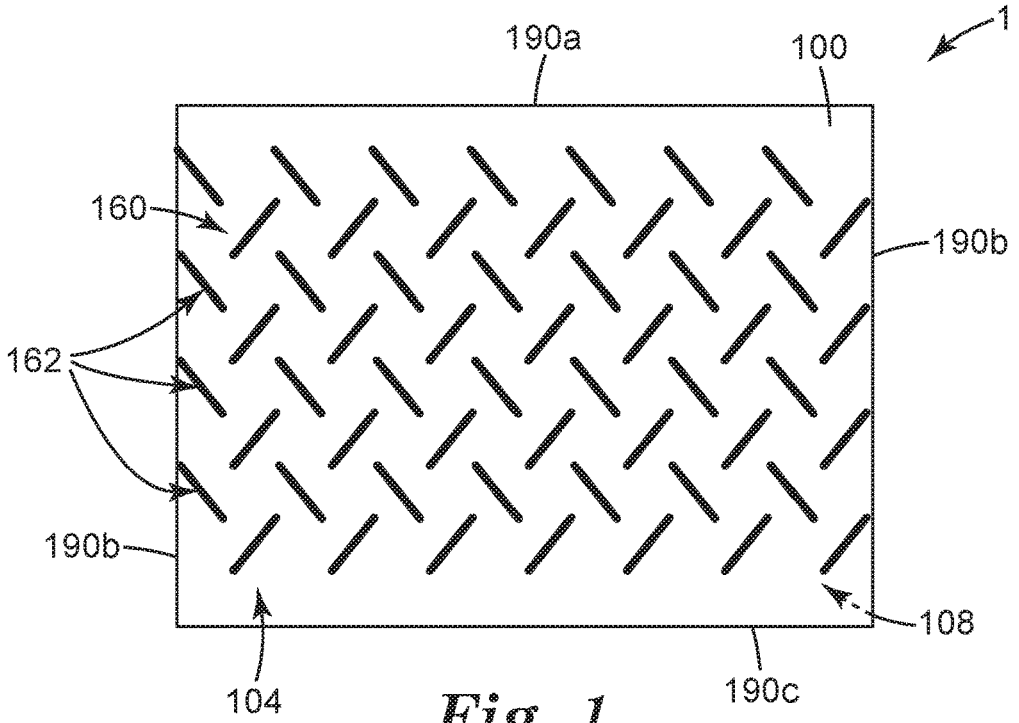
FIG. 1 is a top schematic view of an exemplary scouring article having an array of scouring bodies as disclosed herein.

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 2:
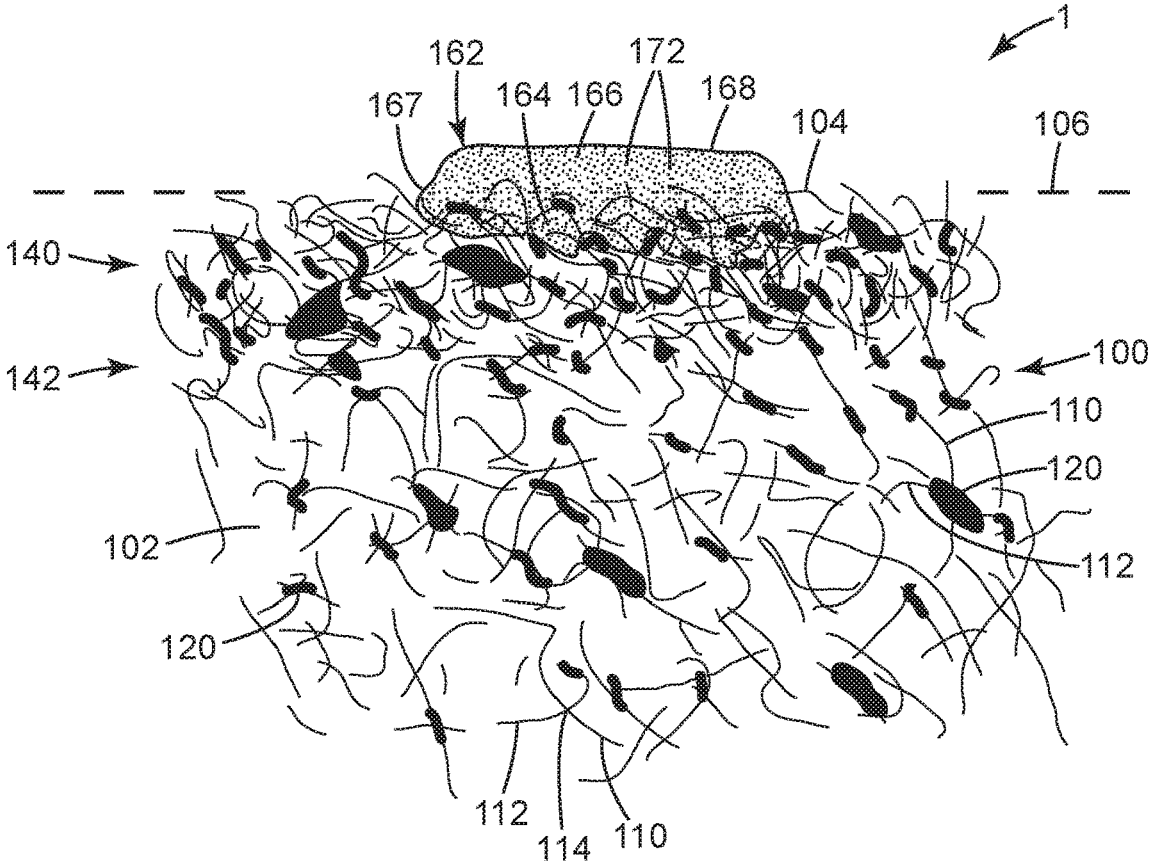
FIG. 2 is a side schematic view of a portion of an exemplary scouring article showing a nonwoven pad as disclosed herein on which the scouring bodies of FIG. 1 are disposed.

FIGS. 1 and 2 show an example embodiment of scouring article 1 having scouring bodies 162 disposed on pad 100. In the present application, scouring bodies 162 can be arranged to convey a message to a user of article 1, such as a message concerning an intended use for article 1 or a characteristic of scouring bodies 162. The message can also comprise other instructions, the type of scouring bodies included in article 1, a surface or device to be cleaned with article 1, or the like. Scouring bodies 162 can also convey the message in multiple languages. Scouring bodies 162 can also provide to the user an indication of the capabilities of article 1. For example, the state or condition of scouring bodies 162, e.g., the functional scouring capabilities of scouring bodies 162, can be indicated by the presence or absence of scouring bodies 162. As such, scouring bodies 162 can be disposed on pad 100 to form various letter, numbers, characters, symbols, glyphs or the like. As such, scouring bodies 162 can serve dual purposes in providing a functional scrubbing capability to article 1, as well as conveying information to a user of article 1. Further description of the message formed by scouring article is described with reference to FIGS. 3-12.

Scouring article 1 can be any type of cleaning article or device that cleans, scours, scrubs, abrades or wipes a surface. Pad 100 can be made of various materials, including, but not limited to, foam (polyurethane, polyethylene, polyuria, etc.) cellulose, natural fibers, wipes, woven cloths, and non-woven materials (airlaid web, carded web, meltspun web, stitchbond web, a wetlaid web, a meltblown and the like). Scouring article 1 can also be constructed by printing scouring bodies 162 onto a film or other suitable substrate and then laminating the substrate to pad 100. Scouring bodies 162 can be attached to pad 100 using any suitable method, including, but not limited to, screen print, spray, stencil, inkjet, flexographic, or gravure print methods. Scouring bodies 162 can also be made of a variety of materials including, but not limited to resins, resins and abrasive particle mixtures, and the like. Further description of one particular embodiment of scouring article 1 is described below with detailed reference to FIGS. 1 and 2.

FIG. 1 is a top view of an exemplary scouring article 1. By a scouring article is broadly meant any article that comprises, on at least a first surface major of the article, an array 160 of scouring bodies 162, which scouring bodies 162 are configured such that when first surface 104 of article 1 is brought into contact with a surface (e.g., a food-contacting surface) and moved about the surface, the scouring bodies 162 can dislodge items that are present on (e.g., adhered to) the surface. Scouring article 1 comprises monolithic nonwoven pad 100, which comprises an interior 102, a first major surface 104, and a second major surface 108, as most easily seen in FIG. 1. Scouring articles suitable for use in the present disclosure are described in additional detail in International Pub. No. WO 2015/123635 to Endle et al., which is hereby incorporated by reference in its entirety for all purposes.

Nonwoven pad 100 may be any suitable nonwoven web, e.g. an airlaid web, a carded web, a meltspun web, a stitchbonded web, a wetlaid web, a meltblown web, and so on. By monolithic is meant that the composition of pad 100 (i.e., in terms of the percentage of fibers of various compositions that are present) is at least substantially the same throughout the thickness of pad 100, including major surfaces 104 and 108 (noting that this does not preclude the collective density at which such fibers are present from differing throughout the thickness of pad 100, as discussed later in detail). By definition, the term monolithic does not encompass pads that are formed by laminating or otherwise attaching one nonwoven pad to another, even if such pads might be of similar or identical composition. However, in other embodiments, laminated or non-monolithic pads can be used with the present disclosure.

An example of a monolithic nonwoven pad can comprise at least some nonwoven fibers that are bonded to each other by fiber-fiber melt-bonding. Specifically, monolithic nonwoven pad 100 can comprise at least some fiber-fiber melt-bonds throughout interior 102 of pad 100, as well as in semi-densified fibrous layer 140 that is described later herein. However, in other embodiments, pad 100 can include only fibers that are not melt-bonded to each other. In some embodiments, at least some fibers of pad 100 may be staple fibers, which are defined herein as fibers that have been cut to an identifiable (e.g., predetermined) length. As such, staple fibers may be distinguished from fibers that are essentially continuous (e.g., meltspun fibers and the like). Staple fibers are typically formed and solidified and then cut to a length and then incorporated into a nonwoven web (as opposed to e.g. being directly collected as a web in the manner of e.g. meltspun or meltblown fibers). Any suitable staple fibers may be used, selected e.g. from synthetic fibers as well as naturally occurring fibers. Suitable synthetic fibers may include organic thermoplastic polymeric materials, which may be e.g. extruded, melt-spun, solvent-spun, and so on. Non-limiting examples of such materials may include e.g. polyamides such as polycaprolactam (nylon 6) and polyhexamethylene adipamide (nylon 6,6), polyolefins such as polypropylene and polyethylene, polyesters such as polyethylene terephthalate, acrylic fibers such as those formed from acrylonitrile, and so on. Other potentially suitable fibers include naturally occurring fibers such as those made from cotton, rayon, silk, jute, bamboo, sisal, wool, hemp, hog's hair, cellulose, and so on. Ceramic or metallic-based fibers may be used if desired. Any such fibers may be virgin fibers or may be reclaimed from e.g. garment cuttings, carpet manufacturing, fiber manufacturing, textile processing, and so on. Blends and mixtures of any suitable fiber types or compositions may be used. In some embodiments, at least some fibers of pad 100 may be first staple fibers 110 that exhibit a first melting point (which first melting point is higher than a second melting point of second staple fibers, if present, as discussed below). Such first staple fibers 110 may impart pad 100 with e.g. stiffness, strength, loft, resiliency, and so on, and may be chosen e.g. from any of the above-listed fibers. In specific embodiments, first staple fibers 110 may be comprised of polyethylene terephthalate (PET), which term is broadly used to encompass any blend, copolymer, and the like that includes PET units.

In some embodiments, at least some fibers of pad 100 may be second fibers 112 that are binding fibers. In this context, a binding fiber is any fiber (e.g., staple fiber) that comprises at least one major component that exhibits a second melting point that is lower than the first melting point of first staple fibers 110. Such binding fibers (e.g. when heated and then cooled as described below) may provide melt-bonding between the binding fibers and the first staple fibers at points of contact therebetween (melt-bonding between the binding fibers themselves may also occur, of course). In some embodiments, such binding fibers may be bicomponent fibers (in accordance with common usage, this term does not limit a fiber to only two components, but rather encompasses multicomponent fibers of any desired number of components). Such bicomponent fibers include at least one component that exhibits a second melting point that is lower than the first melting point of the first staple fibers, and further include at least one additional component that exhibits a third melting point that is higher than the second melting point of the bicomponent fibers. Often, such a higher-melting component of such a bicomponent fiber may be present as a core of the fiber, with a lower-melting component being present as a sheath (although any suitable configuration, e.g. side-by-side, may be used). The third melting point may be, but does not necessarily have to be, similar in value to the first melting point of the above-described first staple fibers. In various specific embodiments, the higher-melting component of such bicomponent fibers may be chosen e.g. from polyesters (e.g., polyethylene terephthalate), poly(phenylene sulfides), polyamides (e.g., nylon), polyimide, polyetherimide or polyolefins (e.g., polypropylene). The lower-melting component of the bicomponent fibers may be chosen as desired. In many embodiments, such a component may be of generally similar chemical composition as the higher-melting component, but may be of a different crystalline structure, may have a higher amorphous polymer content, and so on, so as to exhibit a lower melting point. Or, a lower-melting point component of a bicomponent fiber may be of a different chemical composition from the higher melting point component of the bicomponent fiber. Such differences may range from e.g. the inclusion of monomer units into a copolymer material, to the use of a completely different polymeric material. In some embodiments, second (binding) fibers 112 may be monocomponent fibers that exhibit a lower melting point than the first melting point of first fibers 110. The ordinary artisan will readily understand that binding fibers (whether monocomponent or bicomponent) will soften and e.g. at least partially melt when brought to a sufficiently high temperature. Such fibers may then melt-bond to fibers 110 (and/or to each other) upon cooling and resolidifying, thus serving to transform a mass of fibers into an at least partially self-supporting pad (which pad may be further strengthened by the use of a binder as discussed below). Monocomponent binding fibers may differ slightly from bicomponent binding fibers in that in some instances monocomponent binding fibers may melt so as to partially, almost completely, or completely lose their fibrous form in the bonding process, while bicomponent fibers usually at least partially retain their fibrous form due to the presence of the higher-melting component (e.g., in the fiber core). Either type of binding fiber may be used, alone or in combination.

Staple fibers 110 and/or binding staple fibers 112 may be crimped or uncrimped. The use of crimped fibers may advantageously enhance the loft and/or resiliency of nonwoven pad 100. Crimped fibers are readily available from many sources; or, any suitable fibers may be crimped by the use of a stuffer-box, gear crimpers or the like. If fibers are crimped, the degree of crimping may range from e.g. 2 to 12 crimps per centimeter. In various embodiments, crimped fibers may exhibit a crimp index (measured by the procedures outlined in U.S. Pub. No. 2007/0298697 to Charmoille et al., which is incorporated by reference herein for this purpose) of e.g. from about 35% to about 70%. Staple fibers (whether crimped or not) as used herein may be of any suitable length; e.g. from 0.5 to 15 centimeters. Staple fibers as used herein may be of any suitable denier; e.g. from about 1 to about 200. In specific embodiments, staple fibers (110 and 112) may each range from about 6 to about 20 in denier. Any such fibers may have any desired cross-sectional shape (e.g., circular, triangular, square, multi-lobed, hollow, channeled, and so on). In some embodiments, staple fibers (110 and 112) may be hydrophobic fibers rather than hydrophilic fibers. The ordinary artisan will understand that many conventional fibers (e.g., many polyesters, polyolefins, polyamides, and so on) are inherently hydrophobic in nature unless particular compositions and/or surface finishes are chosen.

Monolithic nonwoven pad 100 includes at least one binder 120 that is distributed throughout pad 100 (i.e., from major surface 104 to major surface 108, including the inwardmost portion of interior 102 of pad 100) in the form of globules at least some of which bind at least some of the fibers of the pad to other fibers of the pad. The term globule is used to broadly encompass a parcel of binder 120 of any shape or aspect ratio, noting that such globules do not necessarily have to be spherical or even approximately spherical in shape. Numerous globules of binder 120 are shown in exemplary representation in FIG. 2. Although some globules may extend for a considerable length along fibers, and/or may contact other globules (e.g. so as to form an at least partial network of binder globules), an arrangement in which binder globules are distributed throughout pad 100 as described herein is distinguished from e.g. an arrangement in which the interstitial spaces of a nonwoven pad are completely filled with binder. Often, binder globules 120 may be provided by way of impregnating a binder precursor into nonwoven pad 100, and then transforming the binder precursor into binder 120. Any suitable binder precursor may be used (noting that although in the art such materials are often referred to as binders, strictly speaking many of them are supplied in the form of a binder precursor that is transformed into the actual binder). In at least some embodiments, such a binder precursor may be provided in the form of a flowable material (e.g., a resin) that is impregnated into pad 100 and is then transformed into the binder by heat (whether by the promotion of cross-linking, the driving off of water and/or solvent, or by a combination of such mechanisms). In some embodiments, such a binder precursor may be provided as a flowable material (e.g. as a hot-melt binder precursor) that is impregnated into pad 100 and then cooled to transform it into the binder. A non-limiting list of suitable binder precursors includes e.g. acrylic resin, phenolic resin, nitrile resin, ethylene vinyl acetate resin, polyurethane resin, polyurea or urea-formaldehyde resin, isocyanate resin, styrene-butadiene resin, styrene-acrylic resins, vinyl acrylic resin, aminoplast resin, melamine resin, polyisoprene resin, epoxy resin, ethylenically unsaturated resin, and combinations thereof. The ordinary artisan will appreciate that such resins encompass both thermosetting and thermoplastic resins. In some embodiments, such a binder precursor may be conveniently applied e.g. as a mixture including water (e.g., as a latex) and may optionally include a crosslinker agent that promotes cross-linking of a polymer in the resin. Non-limiting examples of suitable binder precursors include, for example, Rovene 5900 available from Mallard Creek Polymers (North Carolina, USA), Rhoplex TR-407 manufactured and distributed by Dow Company (New Jersey, USA), and Aprapole SAF17 manufactured and distributed by AP Resinas (Mexico City, Mexico).

Binders and binder precursors of various types are discussed in detail in U.S. Pat. No. 6,312,484 to Chou et al. and in U.S. Pub. No. 2012/0064324 to Arellano, both of which are hereby incorporated by reference in their entirety herein for this purpose (noting that Chou et al. incorporates such binders into a slurry that is coated onto the surface of a nonwoven web rather than e.g. impregnating such binders completely through the thickness of a web).

As will be apparent from discussions herein, in many embodiments a primary function of binder 120 may be to enhance the strength of pad 100 (rather than e.g. to hold abrasive particles in place in or on pad 100). Thus, in some embodiments binder 120 may not include any abrasive particles of any kind (e.g., none of the oft-used inorganic abrasives such as aluminum oxide and so on). However, in other embodiments binder 120 may include abrasive particles (e.g., any of the abrasive particles listed later herein) if desired. Any filler, additive, processing aid, and the like, may be present in binder 120, as desired for any purpose.

Semi-Densified Fibrous Layer

Figure 5:
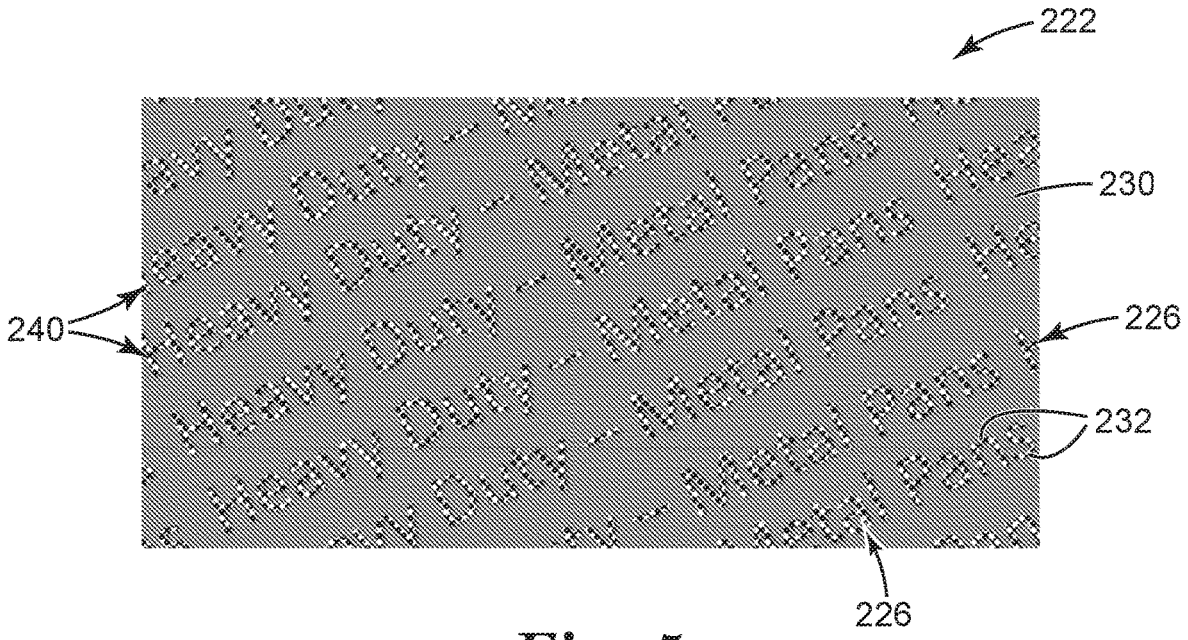
FIGS. 5 and 6 are schematic top views of example scouring articles having printed instructions indicating intended uses for different surfaces.

As seen in exemplary representation in FIG. 2, monolithic nonwoven pad 100 comprises a first semi-densified fibrous layer 140. By "semi-densified" is meant that in layer 140, at least the fibers (e.g., fibers 110 and 112) are present at a higher volumetric density (i.e., in volume of fibers per volume of space) than they are in interior 102 of pad 100. Such an arrangement is shown in exemplary representation in FIG. 2. However, in other embodiments, pad 100 may be comprised of only a non-densified layer, or only a densified layer. In at least some embodiments, binder 120 may also be present at a higher density in layer 140 than it is in interior 102 of pad 100, again as shown in exemplary representation in FIG. 2. The characterization of layer 140 as a "semi-densified fibrous" layer is used to emphasize that layer 140 at least generally retains its fibrous nature and is not densified or consolidated to the point of being a continuous (or even a significantly continuous) skin. This is illustrated in FIG. 5 of the aforementioned Endle et al., which shows an experimentally obtained top view of a layer 140 of a representative Working Example nonwoven pad 100 and which confirms that layer 140 remains essentially fibrous and highly porous in nature. As such, layer 140 is distinguished from e.g. a continuous skin.

It will thus be appreciated that semi-densified fibrous layer 140 is not necessarily very different in character from interior 102 of pad 100; rather, the fibers and binder are merely present at a somewhat higher density in layer 140 than in interior 102.

Nevertheless, the presence of semi-densified fibrous layer 140 can have profound and advantageous effects, as discussed later herein. In some cases this higher density may be characterized in terms of the "solidity" (which term is described in detail e.g. in column 3 lines 17-24 and column 11 line 50 through column 12 line 3 of U.S. Pat. No. 8,162,153 to Fox, which portion is incorporated by reference herein for this purpose) of layer 140 in comparison to the solidity of the interior 102 of pad 100. In various embodiments, layer 140 may exhibit a solidity that is at least about 10, 20, or 30% greater than the solidity of interior 102 of nonwoven pad 100. In further embodiments, layer 140 may exhibit a solidity that is at most about 120, 80, 60, or 40% greater than the solidity of interior 102 of nonwoven pad 100. In some cases, layer 140 may e.g. be so thin as to make it difficult to measure the solidity of layer 140 according to the procedures outlined in U.S. Pat. No. 8,162,153 to Fox et al. In such cases, the solidity may be estimated e.g. by way of optical measurements, x-ray microtomography or the like.

Semi-densified fibrous layer 140 is integral with monolithic nonwoven pad 100 (meaning that at least some fiber segments that provide layer 140 are segments of fibers that have other segments that extend into interior 102 of pad 100) and comprises an outward major surface that provides first major surface 104 of pad 100. Often, layer 140 may extend inwardly from major surface 104 only a very short distance (often, less than about 200 microns) toward the interior of pad 100. In some embodiments, semi-densified fibrous layer 140 may extend inwards into pad 100 a distance that is no more than 10, 5, 2, 1, or 0.5% of the total thickness of pad 100 (with the total thickness of pad 100 being measured along the shortest dimension, between first and second major surfaces 104 and 108). In absolute terms, in various embodiments semi-densified fibrous layer 140 may extend inwards into pad 100 a distance that is no more than about 400, 200, 100, 40, or 20 microns. An inward boundary of semi-densified fibrous layer 140 may sometimes be easily visible, as denoted in FIG. 2 by reference number 142.

However, while the transition between semi-densified fibrous layer 140 and the interior 102 of pad 100 may be fairly clear cut in some cases (as in the exemplary depiction of FIG. 2), it may be more gradual in other cases.

Scouring Bodies

Figure 3:
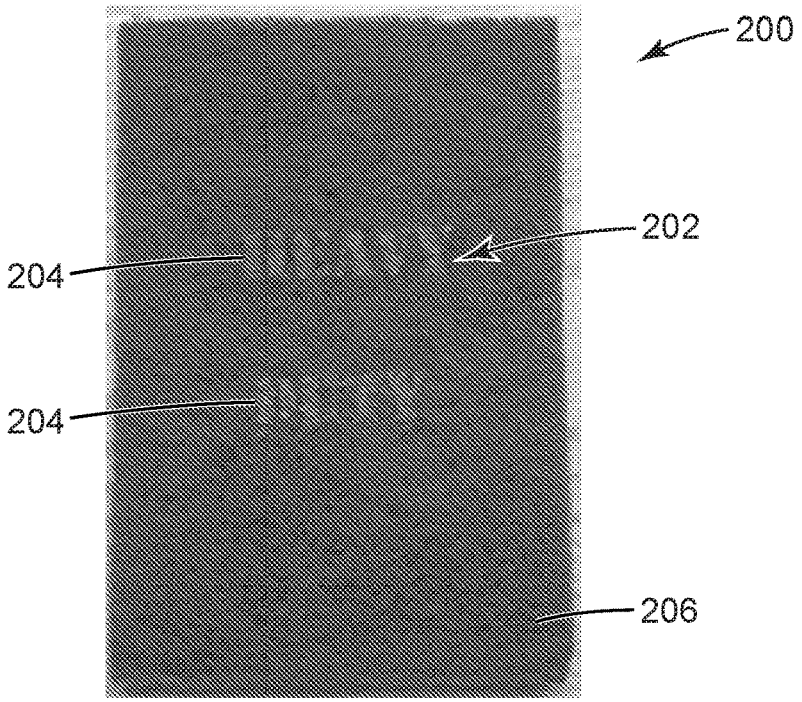
FIG. 3 is a top view of an exemplary scouring article having a printed instruction indicating an intended use.
Figure 8:
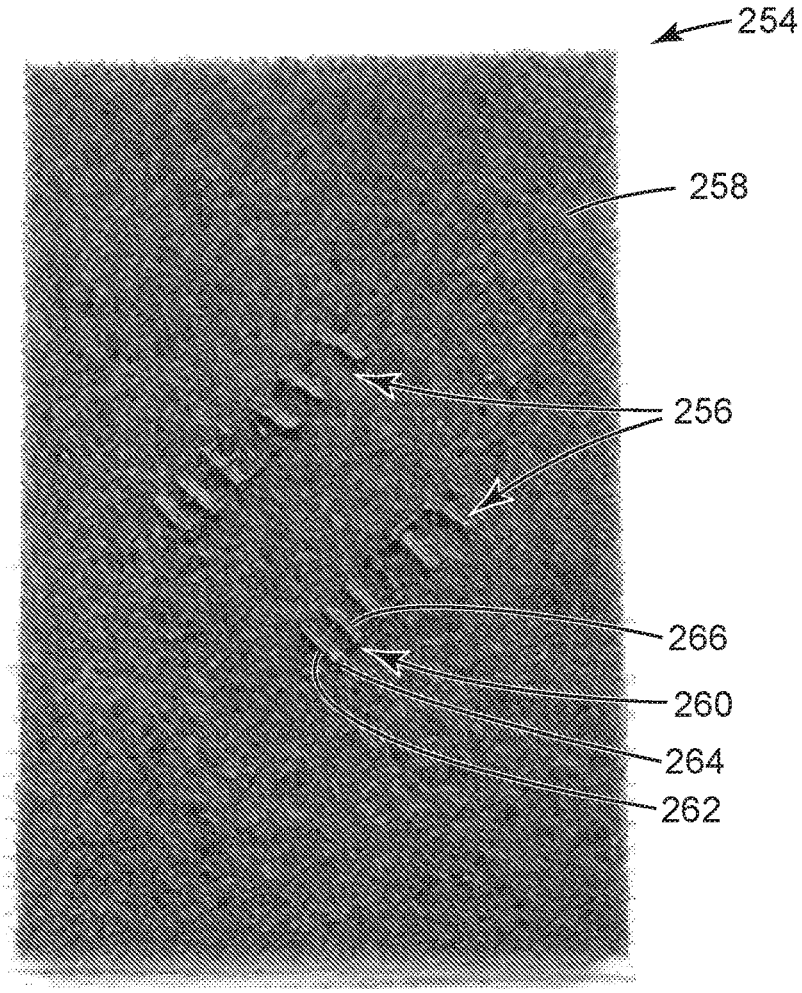
FIG. 8 is a top view of an exemplary scouring article having printed instructions with textured surfaces.

First major surface 104 of nonwoven pad 100 comprises an array 160 of spaced-apart scouring bodies 162, as shown in exemplary representation in FIG. 1. By an array of spaced-apart bodies is meant that scouring bodies 162 collectively occupy less than about 50% of the area of major surface 104, such that exposed areas of surface 104 (as provided e.g. by outward fiber segments of the fibers of pad 100) are present between bodies 162. In various embodiments, scouring bodies 162 may collectively occupy less than about 40, 30, 20, or 10% of the area of major surface 104. In further embodiments, scouring bodies 162 may collectively occupy more than about 5, 10, 20, or 30% of the area of major surface 104. In some embodiments, all of the area of major surface 104 occupied by scouring bodies 162 is part of the printed instruction, as shown in FIGS. 3 and 8 for example. In some embodiments, at least 10% of the area of major surface 104 is occupied by scouring bodies 162 forming the printed instruction. In various embodiments, array 160 may be configured so that bodies 162 are present as discrete islands (as in the exemplary illustration of FIG. 1) that do not contact each other, or as non-intersecting stripes, as a lattice of intersecting stripes, and so on. Any suitable pattern may be used, whether random or regular, repeating or non-repeating and so on. Individual bodies 162 may be of any desired shape (e.g., circular or generally-circular dots, squares, irregular shapes, and so on) and length/width aspect ratio (noting that the term stripe is not limited to straight-line shapes but rather encompasses any desired arcuate shape).

By a scouring body is meant that a body 162 includes at least one component with sufficient hardness to provide a scouring function. Such a component may be any suitable material with a Mohs hardness of at least 3, which materials will be referred to herein for convenience as abrasive materials (while the Mohs scale was originally developed for minerals, the ordinary artisan will appreciate that it is a straightforward scratch-resistance test that can be applied to any desired material). In some embodiments, such a component may be e.g. a particulate additive 172 that is combined with (e.g., mixed into) a precursor resin that is used to form a body 162, or that is dispersed onto a precursor resin after the resin is disposed on major surface 104. In some embodiments such a particulate additive may be any of the well-known inorganic materials (i.e., abrasive particles) that exhibit a Mohs hardness in the range of e.g. 8 to 10 (e.g., aluminum oxide, silicon carbide, alumina zirconia, ceria, cubic boron nitride, diamond, garnet, any suitable ceramic, and combinations of the foregoing). In other embodiments, such a particulate additive may include any organic polymeric material that exhibits a sufficiently high hardness (i.e., a Mohs hardness in the range of at least about 3). Suitable materials may include e.g. particles of melamine-formaldehyde resin, phenolic resin, polymethyl methacrylate, polystyrene, polycarbonate, certain polyesters and polyamides, and the like.

In some embodiments, a scouring body 162 may be made of a material (e.g. a solidified precursor resin) that is sufficiently hard that acceptable scouring performance may be obtained without the presence of a particulate additive. For example, some phenolic resins may provide sufficient hardness, as noted in the Working Examples herein. However, many other polymer resins may be suitable, as will be understood by the ordinary artisan. In general, any of the binder precursors mentioned earlier herein might be considered for use in forming a scouring body 162, as long as the formed binder either exhibits sufficient hardness itself, or is capable of adequately supporting particulate additives that can provide a scouring property. In similar manner to the previously-described binder precursors, a precursor resin used to form scouring bodies 162 may be a thermosetting material or a thermoplastic material, as desired (and may include any filler, additive, processing aid, and the like, as desired for any purpose). Suitable precursor resins may include e.g. the materials described in Examples 21-31 of U.S. Pat. No. 5,227,229 to McMahan McCoy et al., and the materials described in Example 1 of U.S. Pat. No. 7,393,371 to O'Gary et al., both of which are incorporated herein by reference herein for all purposes.

As shown in exemplary illustration in FIG. 2, in at least some embodiments a scouring body 162 may comprise an outward portion 166 that protrudes outward beyond first major surface 104 of pad 100. It will be understood that since first major surface 104 is defined mainly by portions of fibers of pad 100 (and occasionally by portions of binder globules), first major surface 104 does not take the form of an actual, physically flat continuous surface. Rather, first major surface 104 (and the later-described second major surface 108) of pad 100 is provided collectively by fiber portions and/or binder globule portions. For the purposes herein, first major surface 104 can be defined as an imaginary plane at which a flat lower surface of a 2 gram, 0.5 $cm^2$ weight comes to rest when placed on the first side (i.e., the upper side with respect to gravity) of pad 100 (between scouring bodies 162 if present) with the pad 100 supported on a flat surface. Such a weight will be sufficient to compress any stray fiber segments that protrude significantly outward beyond the other fibers of pad 100, while not compressing pad 100 to a significant extent. A representative imaginary plane 106 that denotes a first major surface 104 in this manner is shown in illustrative embodiment in FIG. 2. Second major surface 108 may be similarly established. In various embodiments, an outward portion 166 of a scouring body 162 may protrude at least about 0.05, 0.1, 0.2, 0.4, or 0.8 mm outwardly beyond first major surface 104 of nonwoven pad 100. In further embodiments, an outward portion 166 of a scouring body 162 may protrude at most about 2.0, 1.4, 1.2, 1.0, 0.8, or 0.6 mm outwardly beyond first major surface 104 of nonwoven pad 100. In an embodiment, an outward portion 166 of a scouring body 162 may protrude up to approximately 1.0 mm outwardly beyond first major surface 104 of nonwoven pad 100. In another embodiment, an outward portion 166 of a scouring body 162 may protrude up to approximately 5.0 mm outwardly beyond first major surface 104 of nonwoven pad 100. Such distances may be measured from the above-described imaginary plane 106, to the outwardmost point of outward surface 168 of body 162, along an axis perpendicular to the major plane of pad 100. By comparison, sprayed on printing, such as paint, essentially would not extend beyond first major surface 104.

As also shown in illustrative embodiment in FIG. 2, a scouring body 162 may comprise an inward portion 164 that penetrates at least partially into first semi-densified fibrous layer 140 of nonwoven pad 100. Such penetration may allow scouring body 162 to be firmly anchored to pad 100 so that body 162 is not easily dislodged from pad 100 when body 162 is subjected to shear forces that may occur in the scouring process. However, inward portions 164 of scouring bodies 162 typically do not penetrate far into the interior 102 of pad 100. In various embodiments, inward portions 164 of scouring bodies 162 extend inward from first major surface 104, a distance that is less than about 10, 4, 2, or 1% of the overall thickness of nonwoven pad 100.

In the present application, a cleaning article can include printed instructions or visual information indicating an intended use or application, such as the tasks (i.e. cleaning activities) or areas (i.e. cleaning surfaces) that the cleaning article is intended to be used for, although the cleaning article can be used with other cleaning tasks or areas. In various embodiments, the previously discussed scouring bodies can be printed or deposited onto the previously discussed pads, e.g., a resin of a scouring body, with or without additional particulate additives, can be printed onto a monolithic nonwoven pad formed of fibers and binders in such a manner so as to form letters, numbers, characters, icons, glyphs or the like. As such, the instructions can indicate a class of tasks that can be performed with the cleaning article, and/or a class of surfaces that can be cleaned with the cleaning article. Cleaning articles of the present disclosure can be composed of non-woven materials, sponges, woven cloths or any combination thereof. The information printed on the cleaning article can be in the form of diagrams, depicted actions or words in one or more languages to aid in communication in multi-lingual work environments. An additional aspect of the present disclosure is that the condition or state of the printing may also serve the dual purpose of communicating the effectiveness of the cleaning article. That is, so long as the instructions are legible, the cleaning article can be effective in performing its intended tasks. However, at a point where the instructions become illegible, the cleaning article may no longer be effective in performing its intended task and can or should be replaced by a new cleaning article before performing the intended task.

FIG. 3 is a top view of exemplary scouring article 200 having printed instruction 202 formed of a plurality of scouring bodies 204 printed onto scouring pad 206. Scouring article 200 can be fabricated according to any of the methods described herein. In the depicted embodiment, scouring article 200 includes a non-densified, monolithic, non-woven pad. In particular, pad 206 may comprise a nonwoven pad wherein at least some fibers are bonded to each other by fiber-fiber melt-bonding. Scouring bodies 204, which may comprise a resin having abrasive particulate matter dispersed therein, are placed in close proximity to each other to provide a visual, literary or textual instruction. Each scouring body 204 of instruction 202 can comprise a letter that together spell out and indicate an intended use for scouring article. In the example, of FIG. 3, the intended use conveyed by instruction 202 can correspond to the size or other properties of scouring bodies 204. In the depicted embodiment, instruction 202 includes letters stating "Heavy Duty." In one example, the lettering "Heavy Duty" can indicate that scouring article 200 has large sized scouring bodies 204 that can be used most effectively in conjunction with particular surfaces, such as cast iron pans or the like. In another example, the lettering "Heavy Duty" can indicate that scouring bodies 204 include large sized particulate additive (e.g. particulate additive 172). As discussed with reference to FIGS. 5 and 6, below, the printed instructions can also include a surface intended to be cleaned by the scouring article in addition to the intended use.

Figure 4:
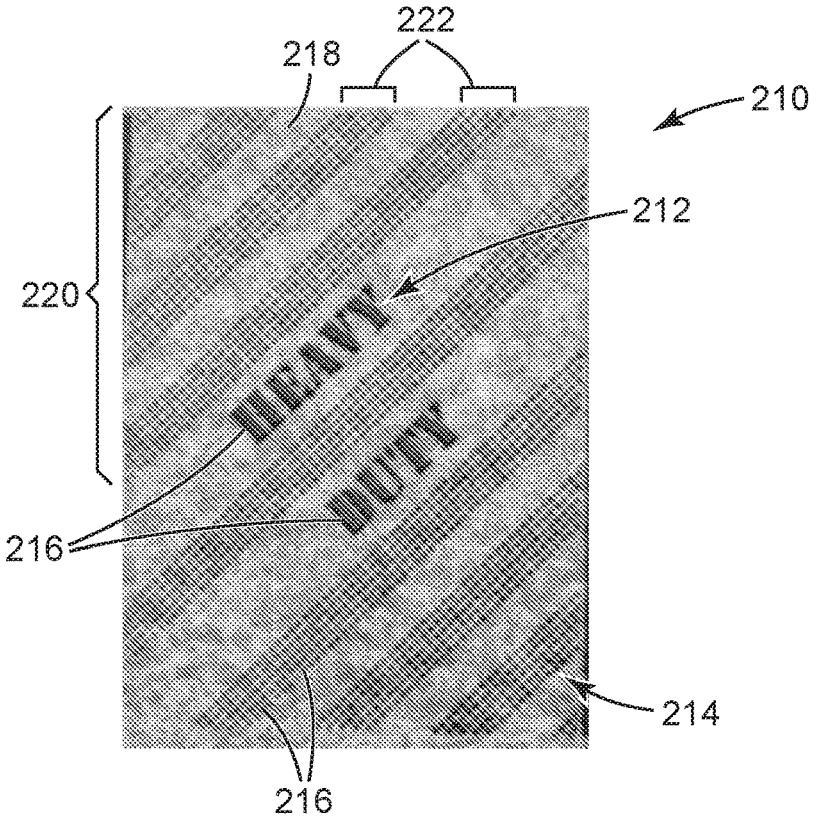
FIG. 4 is a top view of an exemplary scouring article having a printed instruction indicating an intended use with additional scouring features.

FIG. 4 is a top view of exemplary scouring article 210 having printed instruction 212 included with additional scouring features 214. Printed instruction 212 and scouring features 214 can be formed of a plurality of scouring bodies 216. Scouring article 210 can be fabricated according to any of the methods described herein. In the depicted embodiment, scouring article 210 includes a densified, monolithic, non-woven pad. Scouring bodies 216 are placed in close proximity to each other to provide a visual, literary or textual instruction. Each scouring body 216 of instruction 212 can comprise a letter that together spell out and indicate an intended use for scouring article, similar to the embodiment described with reference to FIG. 3. Additionally, scouring features 214 can be arranged in an array or cluster 220 of scouring bodies 216 disposed patterns 222. In the depicted embodiment, cluster 220 comprises a column of angled stripes, and each stripe is formed of a pattern 22 comprising an evenly spaced, tight matrix of dots of scouring bodies. Thus, printed instruction 212 can be combined with additional scouring features 214 that do not convey a message or an instruction, but that increase the overall abrasiveness of the scouring article.

Figure 6:
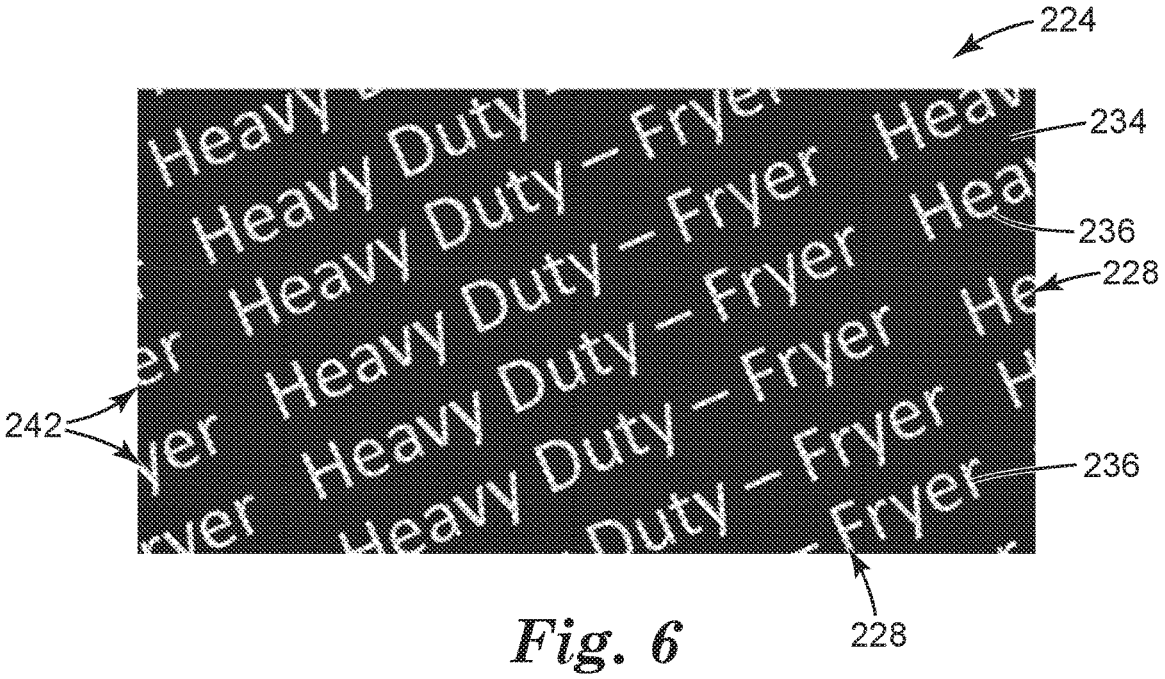

FIGS. 5 and 6 are schematic top views of example scouring articles 222 and 224 having printed instructions 226 and 228, respectively, indicating intended use on different surfaces. Scouring article 222 can comprise pad 230 upon which scouring bodies 232 of instructions 226 are printed. Scouring article 224 can comprise pad 234 upon which scouring bodies 236 of instructions 226 are printed. Scouring articles 222 and 224 can be fabricated according to any of the methods described herein. In the depicted embodiments, scouring articles 222 and 224 include densified, monolithic, non-woven pads.

Printed instructions 226 and 228 can comprise a phrase or phrases that include the type of scouring bodies that can be on the article, as well as a surface or article that can be effectively cleaned with the scouring bodies (e.g., an application of the cleaning article). For example, printed instructions 226 can include letters stating "Heavy Duty—Metal Pans" and printed instructions 228 can include letters stating "Heavy Duty—Fryer." Thus, for example, the size of scouring bodies 232 and 236, or the size of a particulate additive (e.g. particulate additive 172) included within scouring bodies 232 and 236, can be course or large sized for performing "Heavy Duty" cleaning of the desired surfaces. Conversely, printed instructions indicating "Light Duty" can have scouring bodies or particulate additives that are fine or small sized.

Printed instructions 226 and 228 also include a description of a surface or an object that can be effectively cleaned with the stated intended use ("Heavy Duty"). For example, printed instruction 226 refers to "Metal Pans" and printed instruction 228 refers to "Fryer." The intended surface can be an example of a surface to be cleaned with the intended use. In other embodiments, printed instructions 226 and 228 can only include a description of the intended surface or item to be cleaned without an intended use.

FIGS. 5 and 6 additionally show printed instructions 226 and 228 being repetitive in nature. For example, printed instruction 226 can repeat itself within a single row 240, and multiple rows 240 of the repeated instruction can be included. Thus, printed instruction 226 can itself be arranged in an array that covers a portion (e.g. 50% of the surface of pad 230 or less). Likewise, printed instructions 228 can similarly be arranged in rows 242. FIGS. 5 and 6 show printed instructions 226 and 228 being arranged so that letters in rows 240 and 242 are aligned with each other. In other examples, the printed instructions in a single row 240 or 242 can be staggered from the printed instructions above and/or below it. Such staggering can help prevent discontinuity in cleaning from repetitive scrubbing action.

Figure 7:
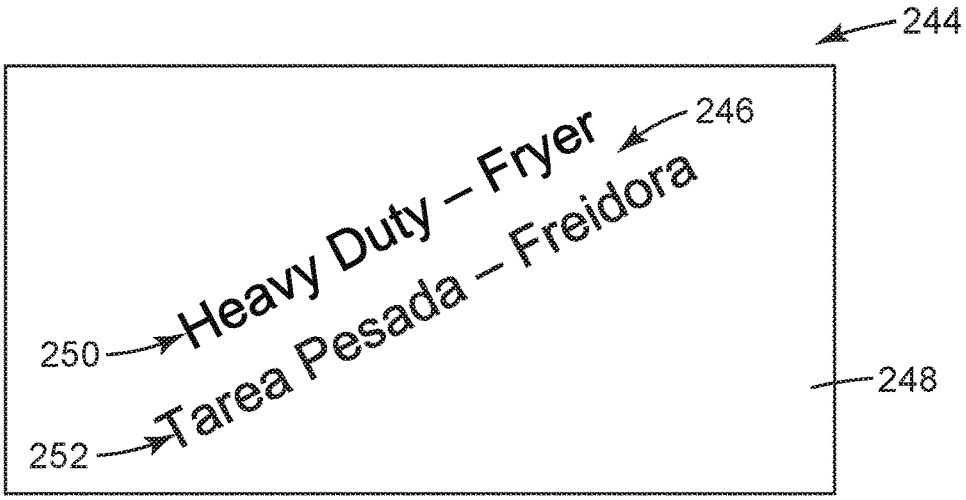
FIG. 7 is a schematic top view of an exemplary scouring article having printed instructions indicating an intended use for a particular surface in multiple languages.

FIG. 7 is a schematic top view of exemplary scouring article 244 having instructions 246 in multiple languages printed on pad 248. In particular, printed instruction 246 can include first instruction 250 and second instruction 252. Each instruction can be one of the instructions for intended use or intended surface described herein, but expressed in different alphanumeric text or letters. Thus, for example, printed instruction 250 can read "Heavy Duty—Fryer" in English while printed instruction 252 can read "Tarea Pesada—Friedora" in Spanish. Any combination of languages can be printed. Scouring article 244 may be fabricated according to any of the methods described herein. In the depicted embodiment, scouring article 244 includes a densified, monolithic, non-woven pad.

FIG. 8 is a schematic top view of an exemplary scouring article 254 having instructions 256 with raised texturing printed onto pad 258. Printed instructions 256 can be made up of scouring features forming various characters, such as character 260. The characters of printed instructions 256 can comprise different letters, numbers or the like. Each character can have a plurality of different facets that give each a plurality of scrubbing surfaces and edges. For example, character 260 can have different facets 262, 264 and 266. Thus, as described above, the scouring features can be raised from the surface of pad 258, and individual portions of each scouring feature can be raised from the surface of pad 266 at a different level to increase the scrubbing effectiveness. Scouring article 254 may be fabricated according to any of the methods described herein. In the depicted embodiment, scouring article 254 includes a non-densified, monolithic, non-woven pad.

Figure 9A:
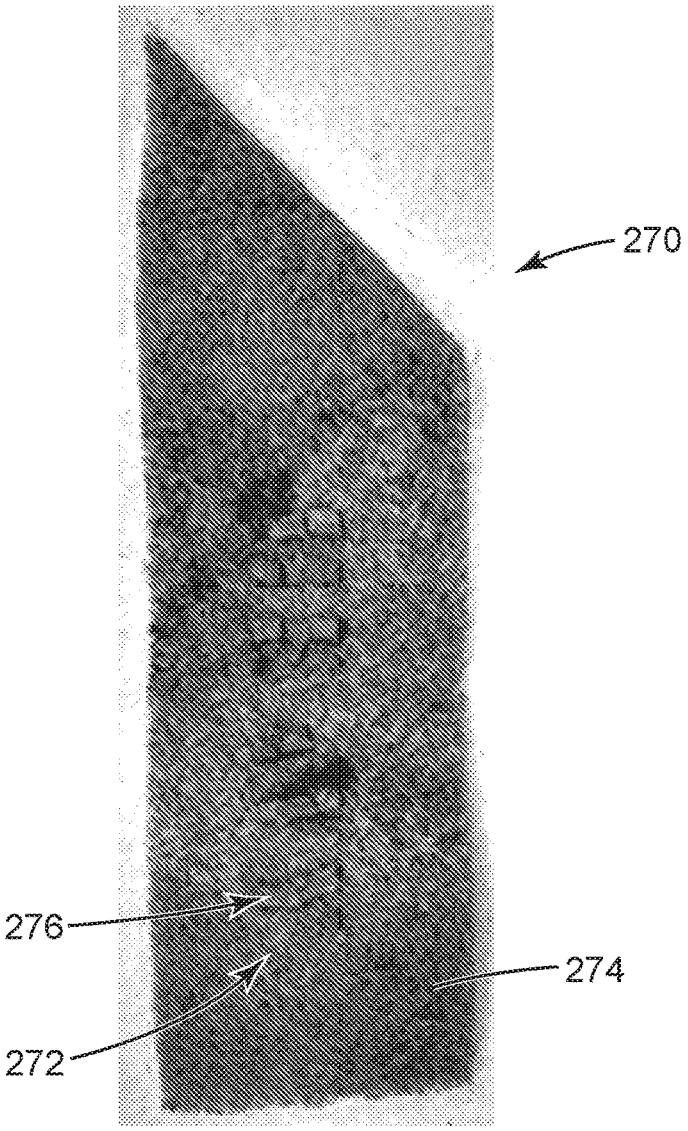
FIGS. 9A and 9B show an exemplary scouring article having scouring bodies that are beginning to wear away.
Figure 9B:
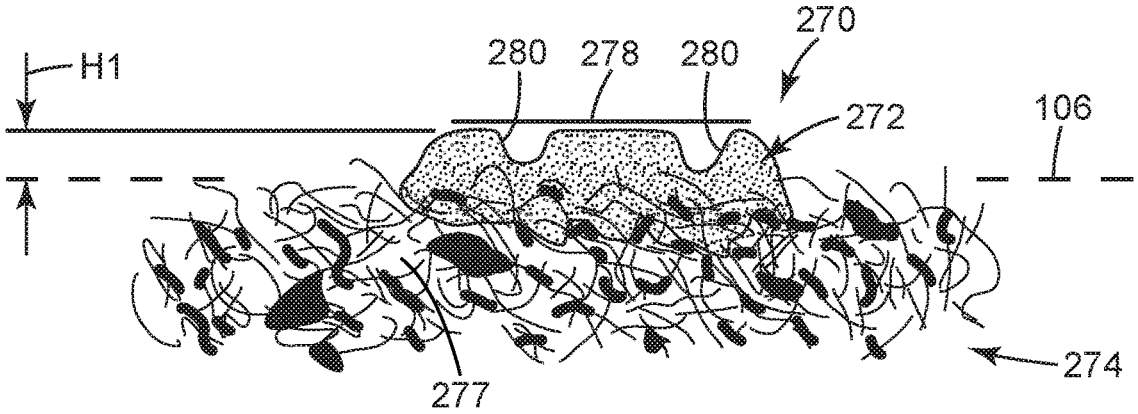

FIGS. 9A and 9B show an exemplary scouring article 270 having scouring bodies 272 that are beginning to wear away. Scouring bodies 272 are printed onto pad 274 and are shaped to form printed instructions 276, which, in the example shown, read with the partial instruction "Heavy." Scouring article was produced for testing purposes and scouring bodies 272 can be arranged to have any instruction described herein. Scouring article 270 may be fabricated according to any of the methods described herein.

As can be seen in FIG. 9A, portions of scouring bodies 272 are in an initially degraded state after scouring article 270 was subject to testing. In the particular example of FIG. 9A, scouring article was subject to thirty cleaning cycles, each cycle comprising a number of simulated manual scrubbing strokes. As can be seen, printed instruction 276 is still legible and scouring bodies 272 still include significant scrubbing surface area.

FIG. 9B schematically shows one of scouring bodies 272 disposed on pad 274, which can include non-densified, monolithic, non-woven interior 277. In other examples, pad 274 may include laminated layers, semi-densified layers, or any other combination of cleaning article constructions as described throughout the present application. As discussed with reference to FIG. 2, the outward or scrubbing surface of pad 274 can align with plane 106. Scouring bodies 272 extend slightly below plane 106 to adhere to pad 274. In an unused or un-degraded state, scouring bodies 272 extend away from plane 106 to plane 278 formed by surface 168 (FIG. 2). However, due to scouring article 270 being subjected to testing where scouring bodies 272 rubbed against a cleaning surface, scouring body 272 has been slightly worn away to height H1 that is below plane 278. Additionally, scouring body 272 has become pitted to include small recesses 280. In such condition, a user of scouring article 270 will not notice any change in the performance of scouring article 270 as compared to when it was first used in a new condition.

Figure 10A:
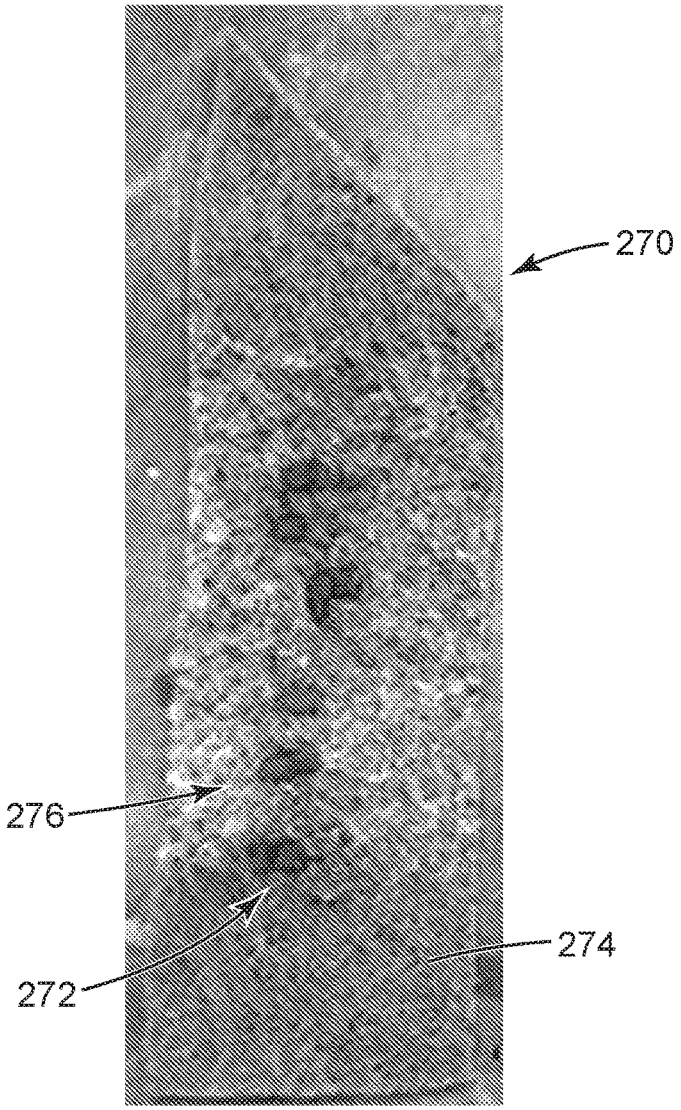
FIGS. 10A and 10B show the scouring article of FIGS. 9A and 9B after additional wear.
Figure 10B:
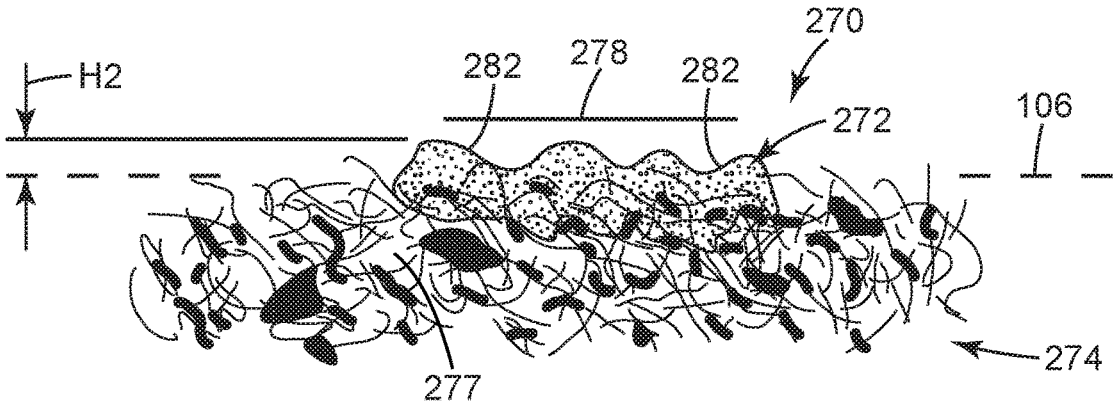

FIGS. 10A and 10B show scouring article 270 of FIGS. 9A and 9B after additional wear to scouring bodies 272. As can be seen in FIG. 10A, portions of scouring bodies 727 are in a further degraded state after scouring article 270 was subject to testing. In the particular example of FIG. 10A, scouring article was subject to one-hundred cleaning cycles. As can be seen, printed instruction 276 has become illegible and the scrubbing surface area of scouring bodies 272 is substantially diminished. FIG. 10B schematically shows one of scouring bodies 272 disposed on pad 270. Due to scouring article 270 being subjected to additional testing from that of FIG. 9B, scouring body 272 has been significantly worn away to height H2 that is below plane 278. Additionally, scouring body 272 has become significantly more pitted to include large recesses 282. In such condition, a user of scouring article 270 will begin to notice a drop off in the performance of scouring article 270 and can replace scouring article 270 with a new one. In one example, scouring bodies 272 form text characters that are still legible after scouring bodies 272 are approximately seventy-five percent consumed.

Figure 11A:
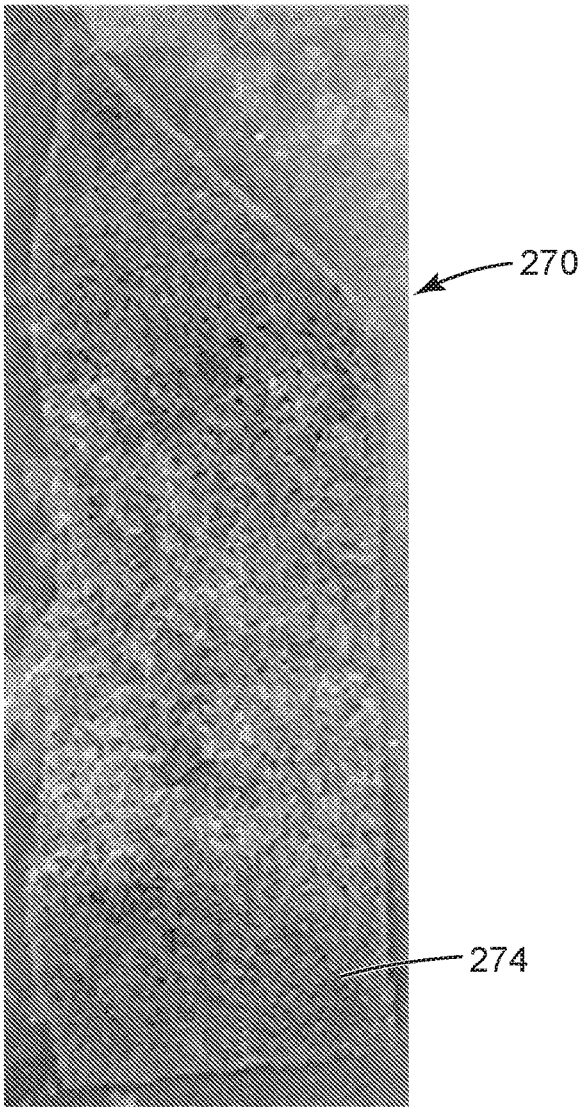
FIGS. 11A and 11B show the scouring article of FIGS. 10A and 10B after the scouring bodies have been substantially worn away.
Figure 11B:
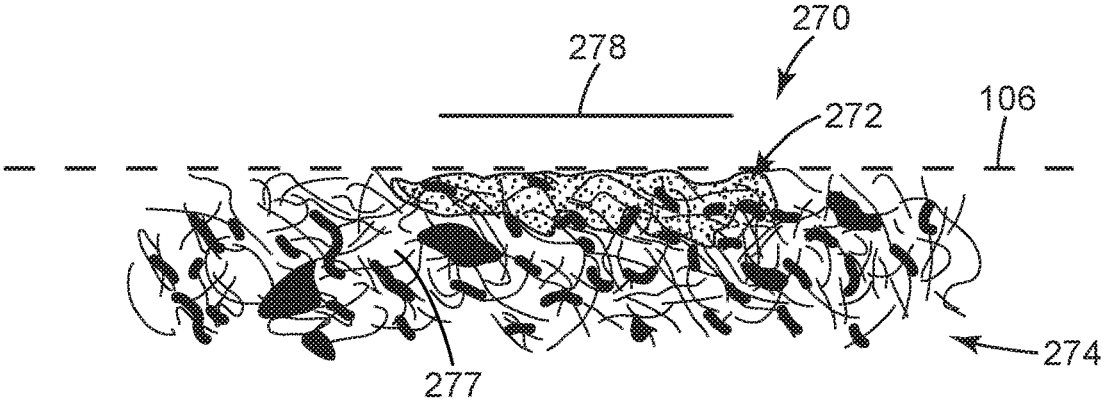

FIGS. 11A and 11B show scouring article 270 of FIGS. 10A and 10B after scouring bodies 272 have been substantially worn away. As can be seen in FIG. 11A, portions of scouring bodies 727 are nearly entirely worn away after scouring article 270 was subject to testing. In the particular example of FIG. 11A, scouring article was subject to one-hundred-forty cleaning cycles. As can be seen, the scrubbing surface area of scouring bodies 272 is negligible. FIG. 11B schematically shows one of scouring bodies 272 disposed on pad 274. Due to scouring article 270 being subjected to additional testing from that of FIG. 10B, scouring body 272 has been worn away so as to not even extend beyond plane 106, thereby completely rendering scrubbing article unfit for performing the intended cleaning activity. At such point, a user of scouring article 270 will know that scouring article 270 needs to be replaced because scouring bodies 272 are absent. Thus, the user does not waste time attempting to clean with the expended cleaning article and a new cleaning article can be obtained before commencing the cleaning activity.

Figure 12:
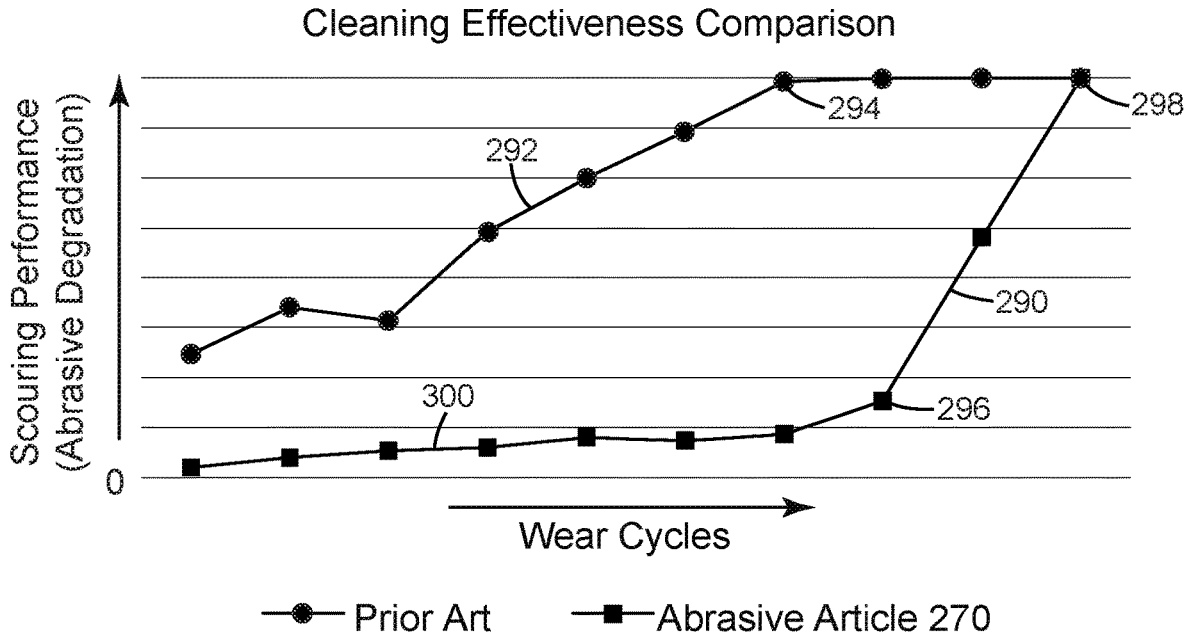
FIG. 12 is a chart showing the performance of the scouring article of FIGS. 9A-11B versus the performance of a prior art scouring article after being subject to the same testing cycles.

FIG. 12 is a chart showing the performance of scouring article 270 of FIGS. 9A-11B versus the performance of a prior art scouring article after being subject to the same testing cycles. In the tested embodiment, scouring article 270 included a non-densified, monolithic, non-woven pad with scouring bodies made of a resin and abrasive particles, while the prior art scouring article included only a non-densified, monolithic, non-woven pad without scouring bodies. The performance of scouring article 270 is shown by curve 290, while the performance of a prior art article is shown by curve 292. Curves 290 and 292 show data relating scouring performance as measured by the Food Soil Test described in the aforementioned Pub. No. WO 2015/123635.

The y-axis or vertical axis indicates the scouring performance of each pad. The scouring results are the measured number of strokes needed to remove food soil from a test panel. In one example, the strokes are manual, linearly reciprocating strokes. As such, a smaller number on the y-axis (e.g., numbers closer to 0) indicates better scouring performance. Thus, a larger number on the y-axis indicates a larger number of strokes needed to remove the food soil, which correlates to increasing degradation of the abrasive material on the pad (or inherently less capable abrasive material).

The x-axis or horizontal axis the number of cycles of accelerated wear a pad is subjected to. Wearing of the pads was accomplished by mounting them in a commercially available BYK Gardner-Scrub linear abrasion test machine with a Norton R428 Durite 60 abrasive belt as the wearing mechanism. More wear cycles are indicated on the x-axis as it extends from left to right. After subjecting a pad to the number of wear cycles at each point along the x-axis, the pad was tested to obtain the number of strokes along the y-axis.

The chart in FIG. 12 shows that scouring performance declines as each pad is subjected to a larger number of wear cycles. In particular, more wear cycles are shown as each of curves 290 and 292 moves to the right in FIG. 12, and a larger number of cleaning strokes required after the indicated number of wear cycles are shown as each of curves 290 and 292 moves up in FIG. 12.

As can be seen in FIG. 12, the prior art scouring article generally degrades at a rate proportional to its use or testing. On the left, curve 292 has a baseline abrasiveness and, as the prior art scouring article performs more wear cycles, degradation of the abrasiveness occurs at each test point until point 294, where performance of the prior art scouring article is effectively void.

Conversely to the prior art scouring article, the degradation of scouring article 270 maintains a relatively stable abrasiveness over the majority of its use or testing. On the left, curve 290 has a baseline abrasiveness and, as scouring article 270 performs more wear cycles, degradation of the abrasiveness occurs gradually until point 296, where, thereafter, performance of scouring article 270 is diminished until performance is void at point 298. For reference, point 298 can correspond to the state of scouring article 270 in FIGS. 11A and 11B, point 296 can correspond to the state of scouring article 270 in FIGS. 10A and 10B, and point 300 can correspond to the state of scouring article 270 in FIGS. 9A and 9B. Thus, FIG. 12 illustrates how the printed instructions of the present disclosure maintain a high level of abrasive or scrubbing effectiveness over a large portion of their lifetime, and then experience a significant drop off near the end of their life. As such, the scouring bodies can provide a visual instruction for an intended use of the scouring article during the effective lifetime of the scouring article, and a user will also have a visual indication that the scouring article needs to be replaced with the visual instruction has substantially disappeared.

Various Notes & Examples

Example 1 can include or use subject matter such as a scouring article, comprising: a backing layer having opposed first and second major surfaces; a visually discernable functional material provided on at least one of the first and second major surfaces; and wherein the functional material comprises a resin, and further wherein the functional material is configured to communicate information to a user of the scouring article regarding an intended end-use application of the scouring article.

Example 2 can include, or can optionally be combined with the subject matter of Example 1, to optionally include functional material that serves as a visual indicator regarding a condition of the scouring article, whereby as the scouring article is used, the functional material wears away and there is a correlation between scouring performance of the scouring article and an amount of functional material remaining on the backing layer.

Example 3 can include, or can optionally be combined with the subject matter of one or any combination of Examples 1 or 2 to optionally include functional material that, as it wears away, it becomes less visually discernable.

Example 4 can include, or can optionally be combined with the subject matter of one or any combination of Examples 1 through 3 to optionally include a relationship that exists between a conspicuity of the functional layer and a scouring performance of the scouring article.

Example 5 can include, or can optionally be combined with the subject matter of one or any combination of Examples 1 through 4 to optionally include functional material that includes at least one of graphical indicia and/or alphanumeric information indicating the intended end-use application of the scouring article.

Example 6 can include, or can optionally be combined with the subject matter of one or any combination of Examples 1 through 5 to optionally include functional material that includes graphical indicia and/or alphanumeric information that indicates a single intended end-use application of the scouring article in two different manners.

Example 7 can include, or can optionally be combined with the subject matter of one or any combination of Examples 1 through 6 to optionally include functional material that is configured to communicate information to a user of the scouring article regarding a single intended end-use application of the scouring article in two languages.

Example 8 can include, or can optionally be combined with the subject matter of one or any combination of Examples 1 through 7 to optionally include functional material that includes at least one of information and use instructions, and further wherein the at least one of information and use instructions includes at least one of the following phrases: non-scratch, heavy-duty, kitchen, and bath.

Example 9 can include, or can optionally be combined with the subject matter of one or any combination of Examples 1 through 8 to optionally include a first portion of the functional material that is configured to communicate information to a user of the scouring article regarding an intended end-use application of the scouring article, and a second portion of the functional material that is configured in an array of scouring bodies arranged proximate the first portion.

Example 10 can include, or can optionally be combined with the subject matter of one or any combination of Examples 1 through 9 to optionally include functional material that is configured to communicate a size of abrasive particles included in the functional material.

Example 11 can include, or can optionally be combined with the subject matter of one or any combination of Examples 1 through 10 to optionally include a backing layer that comprises at least one of an open lofty nonwoven substrate, a fabric substrate, and a textile substrate.

Example 12 can include, or can optionally be combined with the subject matter of one or any combination of Examples 1 through 11 to optionally include a resin that is disposed on the backing layer to communicate the information with a multi-faceted texture that is raised from the backing layer.

Example 13 can include, or can optionally be combined with the subject matter of one or any combination of Examples 1 through 12 to optionally include at least about 50% of the functional material lies above an imaginary plane defined by a plane connecting peaks of the backing layer.

Example 14 can include, or can optionally be combined with the subject matter of one or any combination of Examples 1 through 13 to optionally include functional material that comprises a mixture of abrasive particles and the resin.

Example 15 can include or use subject matter such as an abrasive article comprising: a pad having a scrubbing surface; and a plurality of shaped abrasive structures disposed on the scrubbing surface; wherein the plurality of shaped abrasive structures are arranged to provide an indication regarding a characteristic of the abrasive structures.

Example 16 can include, or can optionally be combined with the subject matter of Example 15, to optionally include a characteristic of the plurality of shaped abrasive structures that comprises a size of particulates of the abrasive structures.

Example 17 can include, or can optionally be combined with the subject matter of Examples 15 or 16, to optionally include a characteristic of the plurality of shaped abrasive structures that comprises a cleaning activity that the abrasive structure is configured to be performed.

Example 18 can include, or can optionally be combined with the subject matter of one or any combination of Examples 15 through 17 to optionally include a characteristic of the plurality of shaped abrasive structures that comprises a surface that the abrasive structure is configured to be cleaned.

Example 19 can include, or can optionally be combined with the subject matter of one or any combination of Examples 15 through 18 to optionally include a characteristic of the plurality of shaped abrasive structures that comprises an effectiveness of the abrasive structures.

Example 20 can include, or can optionally be combined with the subject matter of one or any combination of Examples 15 through 19 to optionally include a plurality of shaped abrasive structures that are arranged to provide a plurality of text characters.

Example 21 can include, or can optionally be combined with the subject matter of one or any combination of Examples 15 through 20 to optionally include a plurality of text characters that are legible after the plurality of shaped abrasive structures are approximately seventy-five percent consumed.

Each of these non-limiting examples can stand on its own, or can be combined in various permutations or combinations with one or more of the other examples.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

In the event of inconsistent usages between this document and any documents so incorporated by reference, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, composition, formulation, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. § 1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description as examples or embodiments, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

The claimed invention is:

1. A scouring article, comprising:

a backing layer having opposed first and second major surfaces;

a visually discernable functional material provided on at least one of the first and second major surfaces;

wherein the functional material comprises a resin, and further wherein the functional material is formed in a shape comprising at least one of a letter, a number, a character, a symbol, and a glyph to communicate information to a user of the scouring article regarding an intended end-use application of the scouring article;

wherein the functional material provides a visual indicator regarding a condition of the scouring article over a range of conditions, whereby as the scouring article is used, the functional material wears away, and there is a correlation between scouring performance of the scouring article and an amount of functional material remaining on the backing layer such that scouring performance declines with a reduction in the amount of functional material over the range of conditions.

2. The scouring article of claim 1, wherein as the functional material wears away, it becomes less visually discernable.

3. The scouring article of claim 1, wherein a relationship exists between a conspicuity of the functional layer and a scouring performance of the scouring article.

4. The scouring article of claim 1, wherein the functional material includes graphical indicia and/or alphanumeric information that indicates a single intended end-use application of the scouring article in two different manners.

5. The scouring article of claim 4, wherein the functional material is configured to communicate information to a user of the scouring article regarding the single intended end-use application of the scouring article in two languages.

6. The scouring article of claim 1, wherein the functional material includes at least one of information and use instructions, and further wherein the at least one of information and use instructions includes at least one of the following phrases: non-scratch, heavy-duty, kitchen, and bath.

7. The scouring article of claim 1, wherein a first portion of the functional material is configured to communicate information to a user of the scouring article regarding an intended end-use application of the scouring article, and a second portion of the functional material is configured in an array of scouring bodies arranged proximate the first portion.

8. The scouring article of claim 1, wherein the functional material is configured to communicate a size of abrasive particles included in the functional material.

9. The scouring article of claim 1, wherein the backing layer comprises at least one of an open lofty nonwoven substrate, a fabric substrate, and a textile substrate.

10. The scouring article of claim 1, wherein the resin is disposed on the backing layer to communicate the information with a multi-faceted texture that is raised from the backing layer.

11. The scouring article of claim 1, wherein at least about 50% of the functional material lies above an imaginary plane defined by a plane connecting peaks of the backing layer.

12. The scouring article of claim 1, wherein the reduction in the amount of functional material over the range of conditions correlates to an increase in visible pitting of the functional material.

13. The scouring article of claim 1, wherein the range of conditions comprises at least: an unused condition, a slightly worn state, a significantly worn state, and a nearly entirely worn state.

14. An abrasive article comprising:

a pad having a scrubbing surface; and a plurality of shaped abrasive structures disposed on the scrubbing surface;

wherein the plurality of shaped abrasive structures are arranged to provide an indication regarding a characteristic of the abrasive structures;

wherein the plurality of shaped abrasive structures are arranged to form a plurality of shapes comprising at least one of a letter, a number, a character, a symbol, and a glyph; and wherein the plurality of shapes are legible by viewing the plurality of shaped abrasive structures after the plurality of shaped abrasive structures are approximately seventy-five percent consumed.

15. The abrasive article of claim 14, wherein the plurality of shaped abrasive structures includes at least one of graphical indicia and/or alphanumeric information indicating the intended end-use application of the abrasive article.

16. The abrasive article of claim 14, wherein the characteristic of the plurality of shaped abrasive structures comprises a size of particulates of the abrasive structures.

17. The abrasive article of claim 14, wherein the characteristic of the plurality of shaped abrasive structures comprises a cleaning activity that the abrasive structure is configured to be performed.

18. The abrasive article of claim 14, wherein the characteristic of the plurality of shaped abrasive structures comprises a surface that the abrasive structure is configured to be cleaned.

19. The abrasive article of claim 14, wherein the characteristic of the plurality of shaped abrasive structures comprises an effectiveness of the abrasive structures.

* * * * *